US006668523B2

(12) United States Patent
Gerber

(10) Patent No.: US 6,668,523 B2
(45) Date of Patent: Dec. 30, 2003

(54) PROCESS FOR THE FINAL FOLDING AND SUBSEQUENT STORAGE OF A PIECE OF LINEN

(75) Inventor: Samuel Gerber, Fraubrunnen (CH)

(73) Assignee: Jensen AG Burgdorf, Burgdorf (CH)

( * ) Notice: Subject to any disclaimer, the term of this patent is extended or adjusted under 35 U.S.C. 154(b) by 18 days.

(21) Appl. No.: 09/953,158

(22) Filed: Sep. 17, 2001

(65) Prior Publication Data

US 2002/0053185 A1 May 9, 2002

Related U.S. Application Data

(63) Continuation of application No. 09/264,859, filed on Mar. 9, 1999, now Pat. No. 6,305,146.

(51) Int. Cl.[7] ..... B65B 11/00

(52) U.S. Cl. ..... 53/461; 53/466; 493/437; 493/449

(58) Field of Search ..... 493/437, 449; 53/116, 117, 120, 527, 529, 531, 535, 466, 461

(56) References Cited

U.S. PATENT DOCUMENTS 3,493,226 A * 2/1970 Weir ..... 493/19
3,531,905 A * 10/1970 Omori ..... 53/447
4,006,576 A * 2/1977 Tetenborg ..... 53/527
4,021,993 A * 5/1977 Widmer ..... 53/120
4,162,603 A * 7/1979 Stromberg ..... 53/438
4,738,078 A * 4/1988 Benz et al. ..... 53/439
5,400,569 A * 3/1995 Jones et al. ..... 53/433

* cited by examiner

*Primary Examiner*—Eugene Kim
(74) *Attorney, Agent, or Firm*—Finnegan, Henderson, Farabow, Garrett & Dunner LLP

(57) ABSTRACT

To fold a piece of linen to a very small final dimension, for example a bed sheet to 9"×6", the piece of linen is kept constantly under pressure after final folding until it has been fixed in a storage position, in order to prevent opening of said final fold. This can be effected by pushing it during final folding by means of a folding sword into a receptacle, from where it is pushed by means of a ram onto a stacking line where its outer surfaces each rest against a corresponding outer surface of an adjacent piece of linen or another stop surface formed by slides or a pressure plate, so that it is fixed in its final configuration. Alternatively, the piece of linen can be fed, while maintaining pressure on the outer surfaces, to a packing apparatus and surrounded there by a strip of packaging material.

2 Claims, 5 Drawing Sheets

PROCESS FOR THE FINAL FOLDING AND SUBSEQUENT STORAGE OF A PIECE OF LINEN

This is a continuation of application Serial No. 09/264,859, filed Mar. 9, 1999 now U.S. Pat. No. 6,305,146 which is incorporated herein by reference.

BACKGROUND OF THE INVENTION

A. Field of the Invention

The invention relates to a process for the automatic final folding and subsequent storage of a piece of linen and a final folding apparatus for folding a piece of material, such as a linen, and transferring it for subsequent storage. A known process of this general type and such a final folding apparatus are described, for example, in the brochure JENSEN TEXTILE JENTEX from AKAB of Sweden AB, Bussgatan 4, SE-504 94 and from Jensen AG Burgdorf, CH-3400 Burgdorf.

B. Description of the Related Art

The known process of the general type is suitable for folding a piece of linen to a specific final dimension where the weight of the parts themselves is sufficient to hold the piece of linen in the final configuration achieved. Recently, however, especially with regard to the desire for the folded pieces of linen to occupy a small area in deliveries and the like, requirements are set with respect to the final dimension which can no longer be met by automatic folding in a conventional manner since the pieces of linen folded very small immediately open again, completely or partly eliminating the final folding.

Folds to such final dimensions have therefore been carried out manually to date, which however requires considerable effort owing to the high folding pressure to be applied and the required control over the piece of linen until storage or intermediate storage.

SUMMARY OF THE INVENTION

It is the object of the invention to develop the known process of the generic type so that it permits automatic final folding of a piece of linen to a small final dimension. This object is achieved by an apparatus for folding material having a draw-in surface defining a gap, a folding member configured to be advanced and retracted through the gap, and a transfer mechanism. The transfer mechanism is aligned with the gap an disposed on a side of the draw-in surface opposite to the folding member in retracted position. The transfer mechanism comprises a receptacle including parallel first and second surfaces configured to engage respective outer surfaces of the folded material prior to transfer. The second surface is movable relative to the first surface between and engaged position engaging the outer surface of the folded material and a disengaged position allowing the folded material to be transferred from the receptacle. The apparatus according to the present invention is suitable for carrying out final folding to small final dimensions.

Another aspect of the invention includes a process for the automatic final folding of material including a final folding leading to a configuration having a first outer surface and a second outer surface parallel to the first outer surface. The process includes directing forces on the outer surfaces toward each other after the folding step. The forces are continued during transfer of the folded material from a folding section to subsequent storage, wherein the forces result from stops acting against the outer surfaces of the folded material.

The advantages achieved by the invention are that pieces of linen can be automatically folded to very small final dimensions and can be brought to a stable storage position. In particular, for example, bed sheets can be folded to 9"×6" so that they require a very small area.

BRIEF DESCRIPTION OF THE DRAWINGS

The accompanying drawings are included to provide a further understanding of the invention and are incorporated in and constitute a part of this specification. The invention is illustrated in more detail below with reference to Figures which merely represent embodiments. In the drawings.

DETAILED DESCRIPTION

Figure 1A:
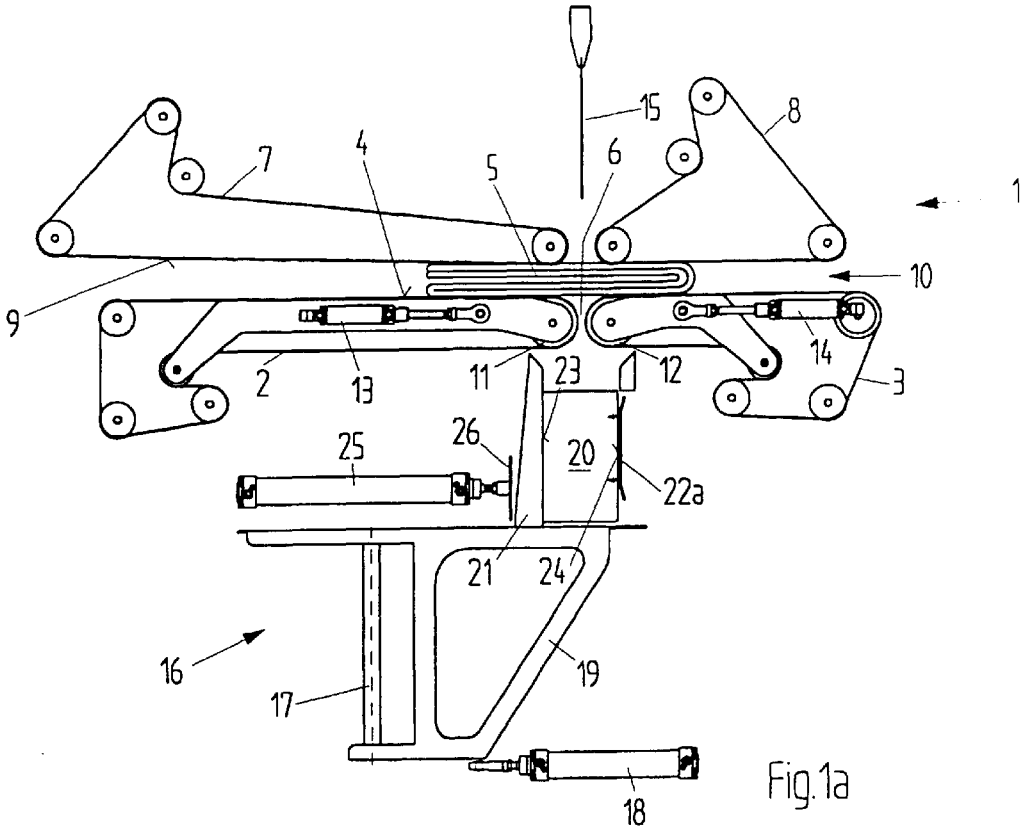
FIG. 1*a* shows a side view of a novel final folding means, according to a first embodiment of the invention, in a first phase of final folding with subsequent stacking.

Reference will now be made in detail to the present preferred embodiments of the invention illustrated in the accompanying drawings. Wherever possible, the same reference numbers are used throughout the drawings to refer to the same or like parts.

According to a first embodiment, the final folding station according to the invention comprises a folding apparatus 1 having a first draw-in belt 2 and a second draw-in belt 3 whose upper belt sides form an upward-facing draw-in surface 4 for receiving a piece of linen 5, which draw-in surface is interrupted by a gap 6. Arranged above the conveying surface 4 are two guide belts 7, 8 whose lower belt sides form a guide surface 9 which is parallel to the draw-in surface 4 and is likewise interrupted above the gap 6. The draw-in surface 4 and the guide surface 9 between them form a draw-in channel 10.

Rollers 11, 12, over which the draw-in belts 2, 3 are guided at the gap 6, can be pulled back from a starting position of the final folding means (FIG. 1*a*) by pneumatic cylinders 13, 14 for widening the gap 6. A folding sword 15, likewise in the starting position, is arranged above the guide belts 7, 8. It can be lowered through the gap in the guide surface 9 and the gap 6 underneath in the draw-in surface 4, by an actuating device which is not shown.

A transfer device 16 is arranged below the folding apparatus 1. Said transfer device comprises a frame 19 which can be rotated about a perpendicular axis 17 by means of a pneumatic cylinder 18 and which carries a receptacle 20 which is a distance away from the axis 17 and, in the starting position, is arranged directly below the gap 6 and is parallel to it. It is bounded by a back panel 21 and two wings 22*a, b* which are arranged a distance away from said back panel, can be folded away outwards about perpendicular axes against elastic forces and form approximately parallel stop surfaces 23 and 24, respectively, which face one another and may diverge slightly from one another at the upper edges. Behind the back panel 21 and fastened to the frame 19 is a further pneumatic cylinder 25 whose piston carries a [disc-shaped ram 26 which,] disc-shaped ram, alternatively referred to as a "first stacking member," which when in the starting position, is present behind the back panel 21 and can be moved forward through a round opening in said back panel and between the wings 22*a*, 22*b*.

The frame 19 can be swivelled from the starting position about the axis 17 into a transfer position (FIGS. 1*c*, 2*a*), in which a stacking line 27 (FIGS. 2*a–c*, omitted in FIGS. 1*a–c*) directly adjoins the receptacle 20. Said stacking line has a sliding plate 28, alternatively referred to as a "second stacking member," and lateral guide plates 29*a, b* which together bound a stacking channel 30 which declines slightly towards the receptacle 20. The stacking channel 30 is closed off from the receptacle 20 in a starting position (FIG. 2*a*) by two slides 31*a, b* which are provided in the middle with semicircular recesses and can be laterally retracted by means of two pneumatic cylinders 32*a, b*. On the opposite side, it is bounded by a pressure plate 33 which can be moved with application of a certain pressure towards that end of the stacking line 27 which is opposite the receptacle 20. The transfer device 16 may also be formed in such a way that it can assume a plurality of transfer positions characterized by various angles of rotation of the frame 19 relative to the axis of rotation 17 and from which positions the stacking lines, which may be formed identically to the stacking line described, radiate outwards in a star-like manner.

Figure 1B:
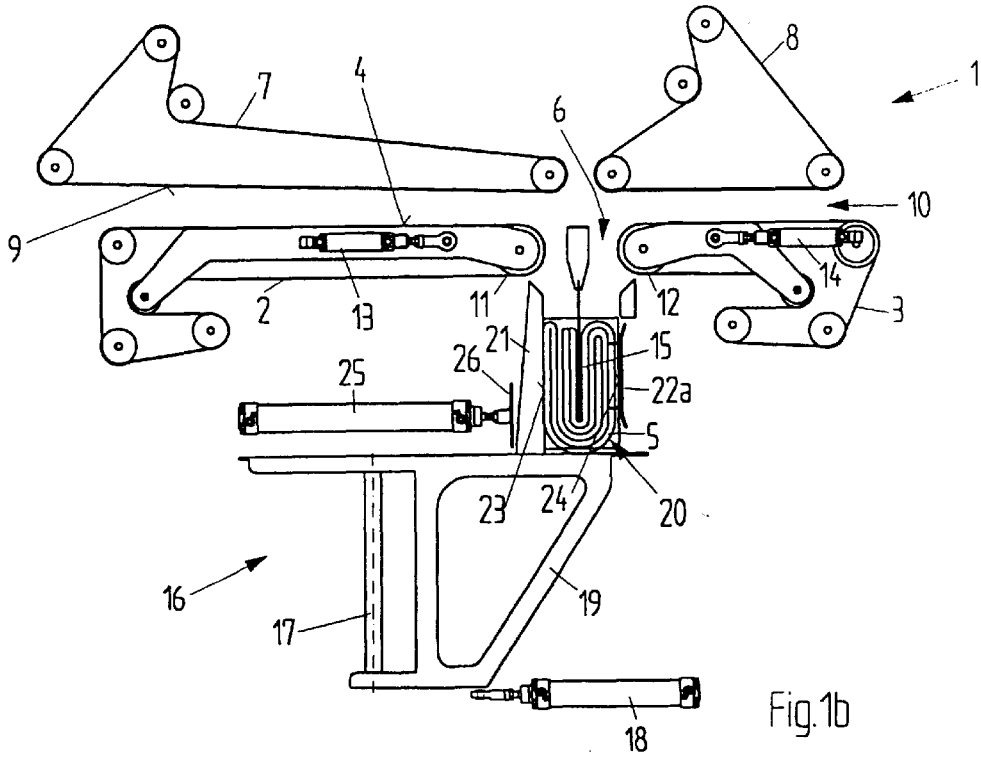
FIG. 1*b* shows a side view corresponding to FIG. 1*a*, with the final folding means in a second phase of final folding with subsequent stacking.
Figure 1C:
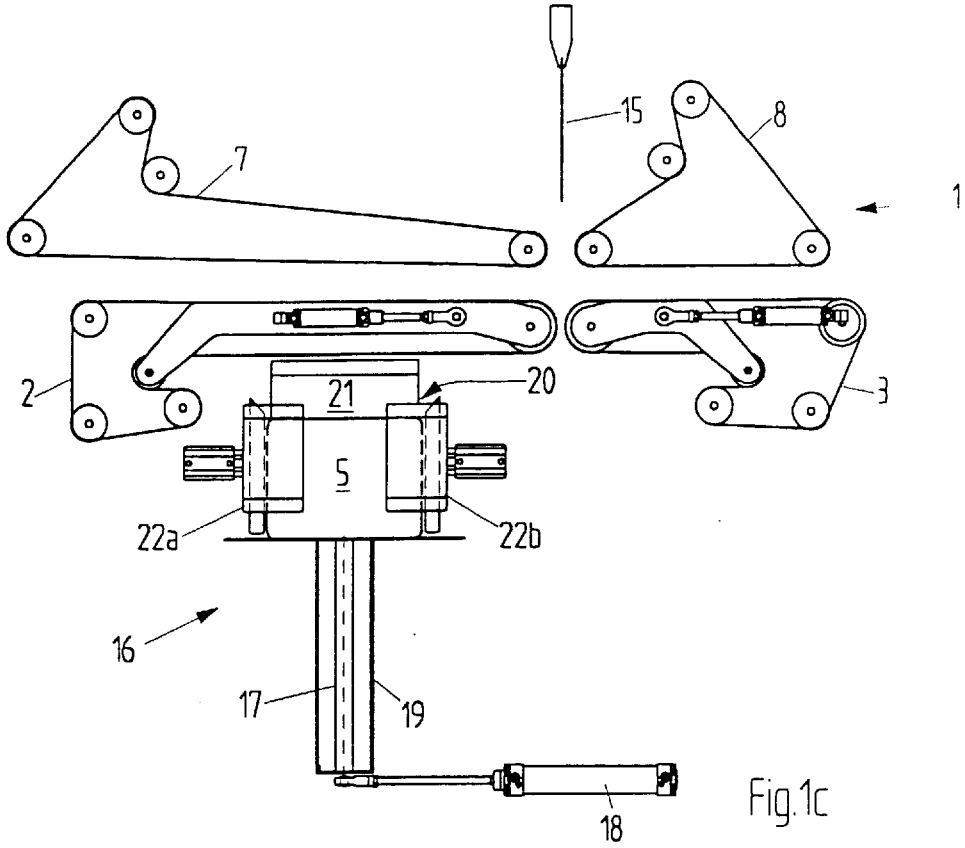
FIG. 1*c* shows a side view corresponding to FIG. 1*a*, with the final folding means in a third phase of final folding with subsequent stacking.
Figure 2A:
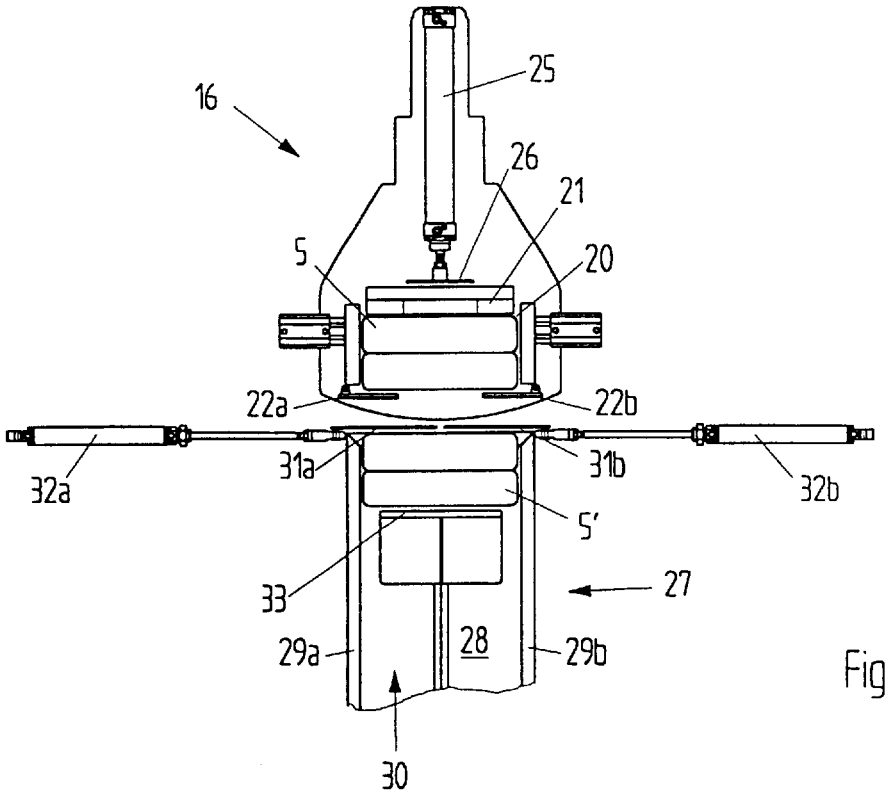
FIG. 2*a* shows a plan view of the final folding means of FIG. 1*c*.
Figure 2B:
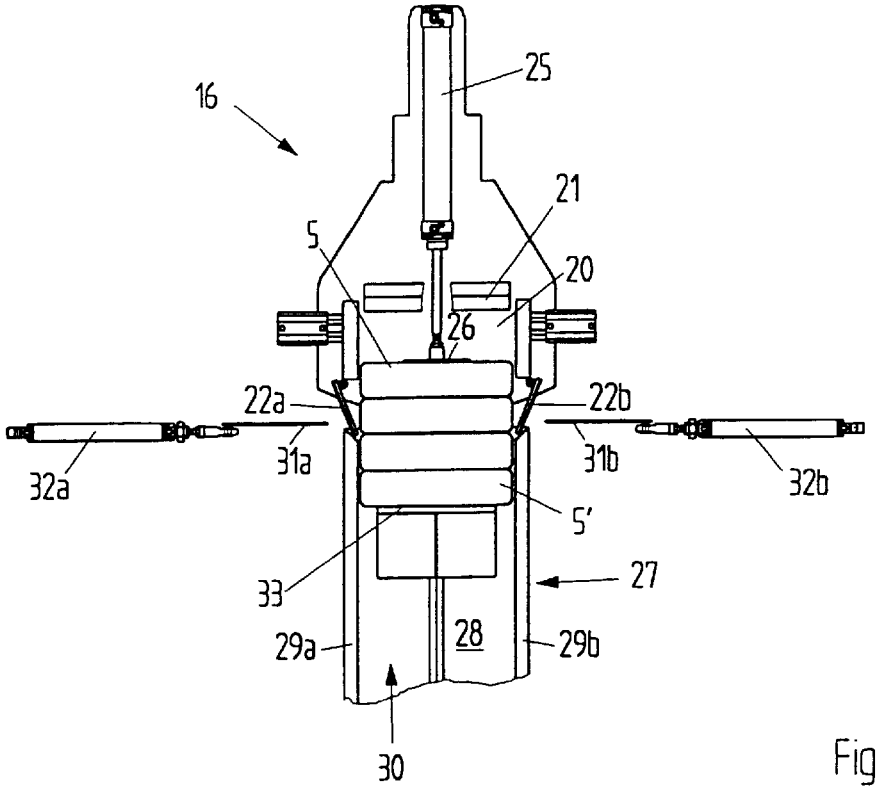
FIG. 2*b* shows a plan view corresponding to FIG. 2*a*, with the final folding means in a fourth phase of final folding with subsequent stacking.

The final folding means shown in FIGS. 1*a–c*, 2*a–c* may be formed as an independent module which connects with a folding station of a known type. The piece of linen 5 arriving from the folding station, for example a bed sheet which was brought to a size of 9"×12" by being folded several times, is drawn into the draw-in channel 10 at the left end of the final folding means by corresponding movement of the first draw-in belt 2 and of the first guide belt 7 and, finally also by means of the second draw-in belt 3 and of the second guide belt 8, is moved to the right until its middle is located exactly above the gap 6 and below the folding sword 15 (FIG.1*a*).

Final folding is then formed by widening the gap 6 by slightly pulling apart the rollers 11, 12 and lowering the folding member, such as, for example, sword 15 through said gap and thus pressing the piece of linen 5 so that the middle of its lower side moves downwards into the receptacle 20, while at the same time its laterally connecting parts are folded back by contact, or engagement, with the stop surfaces 23, 24 so that they form parallel outer surfaces of the finally folded piece of linen 5, which now has final dimensions of 9"×6". Opening of the piece of linen 5 is prevented by the further action of the stop surfaces 23, 24, which exert forces of reaction which are directed at the outer surfaces towards the middle of the receptacle 20. The piece of linen 5 is therefore held by said forces in the final configuration achieved, against its tendency to unfold again (FIG. 1*b*).

Figure 2C:
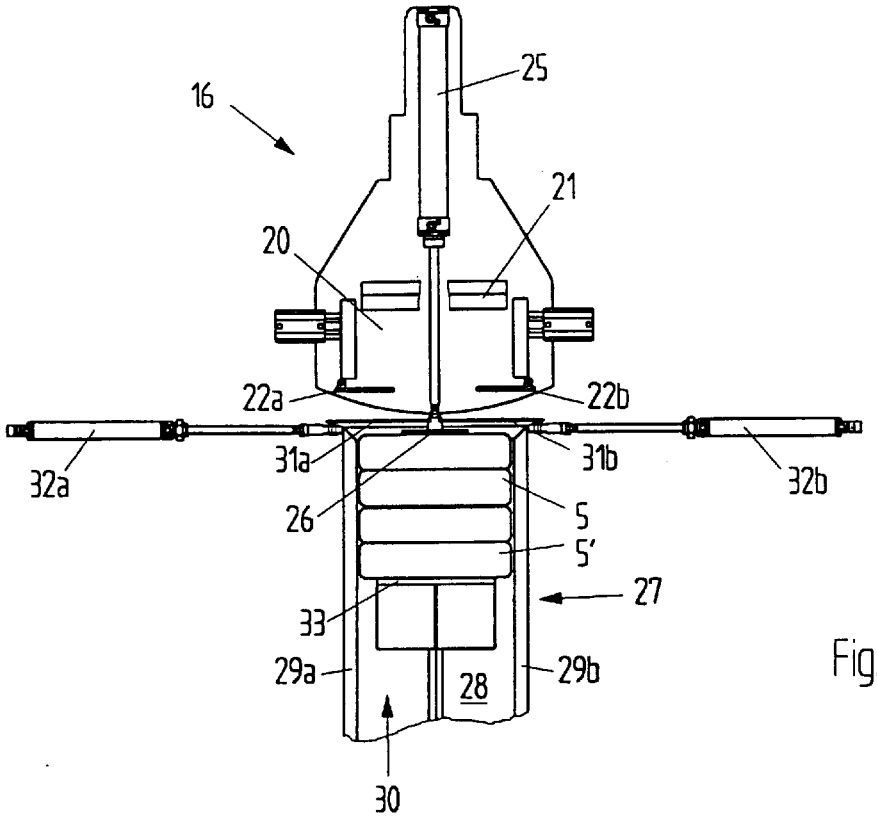
FIG. 2*c* shows a plan view corresponding to FIG. 2*a*, with the final folding means in a fifth phase of final folding with subsequent stacking.

The frame 19 is then rotated by means of the pneumatic cylinder 18 through 90° to a transfer position so that the receptacle 20 is now directly opposite one end of the stacking line 27 (FIGS. 1*c*, 2*a*). After retraction of the slides 31*a,b*, the piece of linen 5 can then be pushed into the stacking channel 30 by advancing the ram 26 while the wings 22*a,b* swivel away laterally (FIG. 2*b*) to disengage from the outer surface of the linen, after which the slides 31*a,b* travel back to the starting position (FIG. 2*c*). The ram 26 can then be withdrawn through the circular opening formed by the recesses in the slides 31*a,b* and further between the wings 22*a,b* and through the opening in the back panel 21.

The finally folded piece of linen 5 is now in a storage position in which it rests with one of its outer surfaces against a corresponding outer surface of a previously finally folded piece of linen 5', and with its opposite outer surface, parallel to the first-mentioned outer surface, against the slides 31*a,b*. It is obvious that the two outer surfaces of a piece of linen each rest against an outer surface of an adjacent piece of linen or against another stop surface formed by the slides 31*a,b* or the pressure plate 33. Consequently, each piece of linen is fixed in its final configuration in this storage position and opening of the final fold cannot occur. When stacking line 27 is full, or even earlier, the stack as a whole can be removed and, for example, packed. If a plurality of stacking lines and corresponding transfer positions are present, the latter can be approached, for example, alternately so that the stacking lines are filled uniformly.

According to a second embodiment, the final folding means according to the invention once again comprises a folding apparatus 1 which, with draw-in belts 2, 3 and guide belts 7, 8, whose upper and lower belt sides form a draw-in surface 4, interrupted by a gap 6, and a corresponding guide surface 9, which enclose a draw-in channel 10, and, with a folding sword 15, essentially corresponds to the folding apparatus of the final folding means according to the first embodiment. However, the draw-in channel 10 slopes upwards and the folding sword 15 is inclined in the draw-in direction of the piece of linen 5. In addition, only the roller 11, over which the first draw-in belt 2 runs, is displaceable for changing the width of the gap 6, but not the opposite roller 12. A horizontal feed belt 34 is arranged upstream of the first draw-in belt 2.

Present directly below the gap 6 is a folding belt 35 which slopes slightly downwards and whose upper belt side forms, with that belt side of the second draw-in belt 3 which runs above said folding belt, a folding channel 36 which extends to the end of the folding apparatus 1. The folding apparatus 1, as well as a subsequent packing apparatus 37, is in the form of an independent transportable station.

The packing station 37 has, at the entrance, an approximately horizontal first transfer belt 38 whose upper belt side, together with that lower belt side of an upper transfer belt 39 which runs parallel above said upper belt side, bounds a transfer channel 40 which is directly adjacent to the folding channel 36 and leads to a packing channel 41 which is likewise virtually directly adjacent and is present between an upper belt side of a first packing belt 42 and that belt side of a second packing belt 43 which runs parallel above said first packing belt. The widths of the transfer channel 40 and of the packing channel 41 correspond approximately to the width of the folding channel 36.

Arranged below the first packing belt 42 and above the second packing belt 43 are storage rollers 44 and 45, respectively, which each carry a web 46 and 47, respectively, of a strip-like weldable packaging material, for example a plastics film, which is guided over a guide roller 48 or 49, respectively, arranged upstream of the first packing belt 42 and of the second packing belt 43, respectively, into the packing channel 41, where it is present between the first packing belt 42 or the second packing belt 43 and any piece of linen 5. Arranged directly behind the end of the packing channel 41 is a connecting device having two heatable welding stamps 50, 51 which can be advanced towards one another perpendicularly to the middle of the packing channel 41 and which is followed by a delivery belt 52 at the height of the first packing belt 42.

Figure 3A:
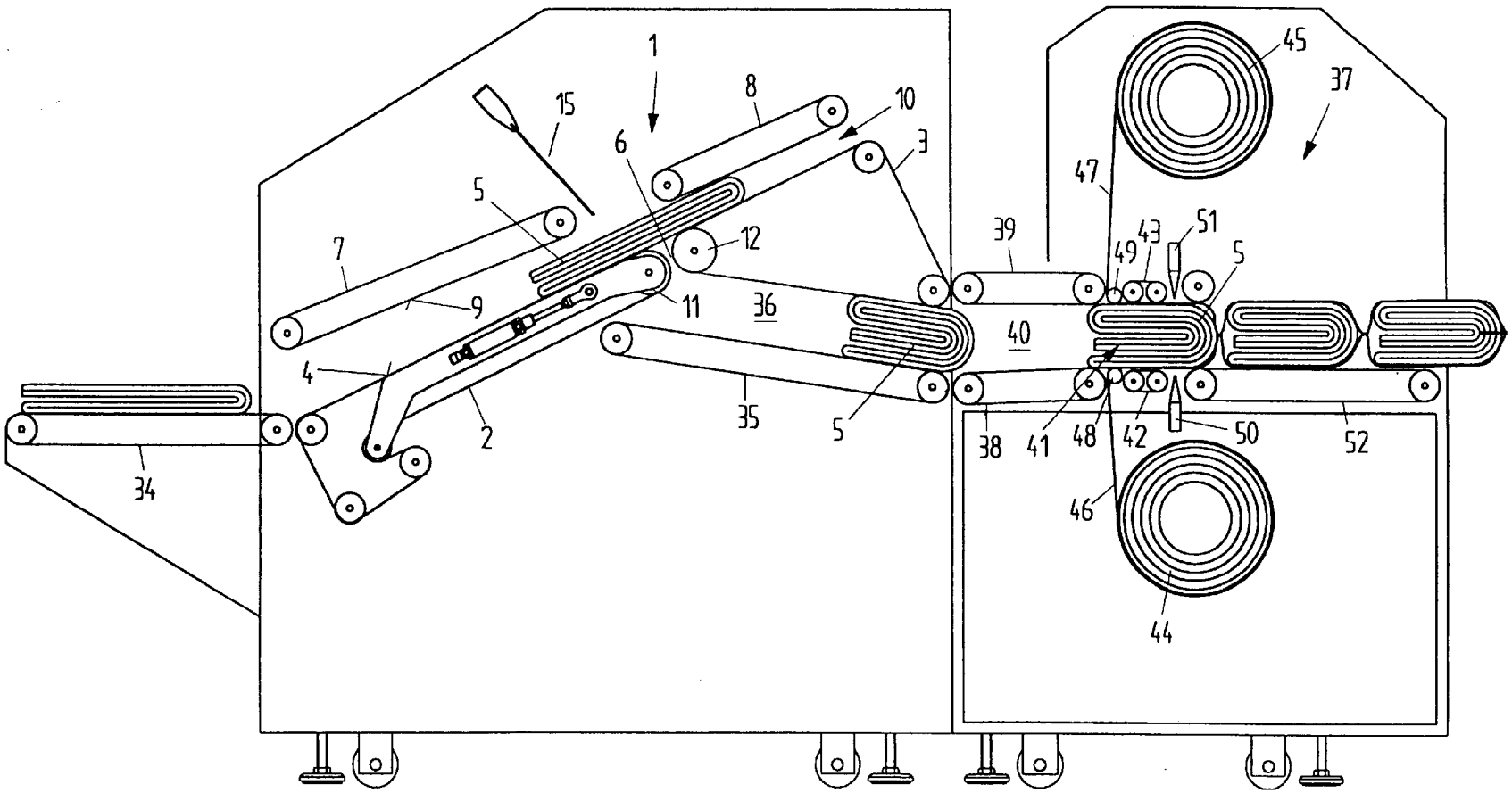
FIG. 3*a* shows a side view of a novel final folding means according to a second embodiment of the invention, in a first state.

A piece of linen 5 placed on the feed belt 34 or arriving from an upstream folding apparatus is drawn into the draw-in channel 10 at the left end of the final folding means by corresponding movement of the first draw-in belt 2 and of the first guide belt 7 and, finally also by means of the second draw-in belt 3 and of the second guide belt 8, is moved to the right until its middle is present above the gap 6 and inclined below the folding sword 15 (FIG. 3*a*).

Figure 3B:
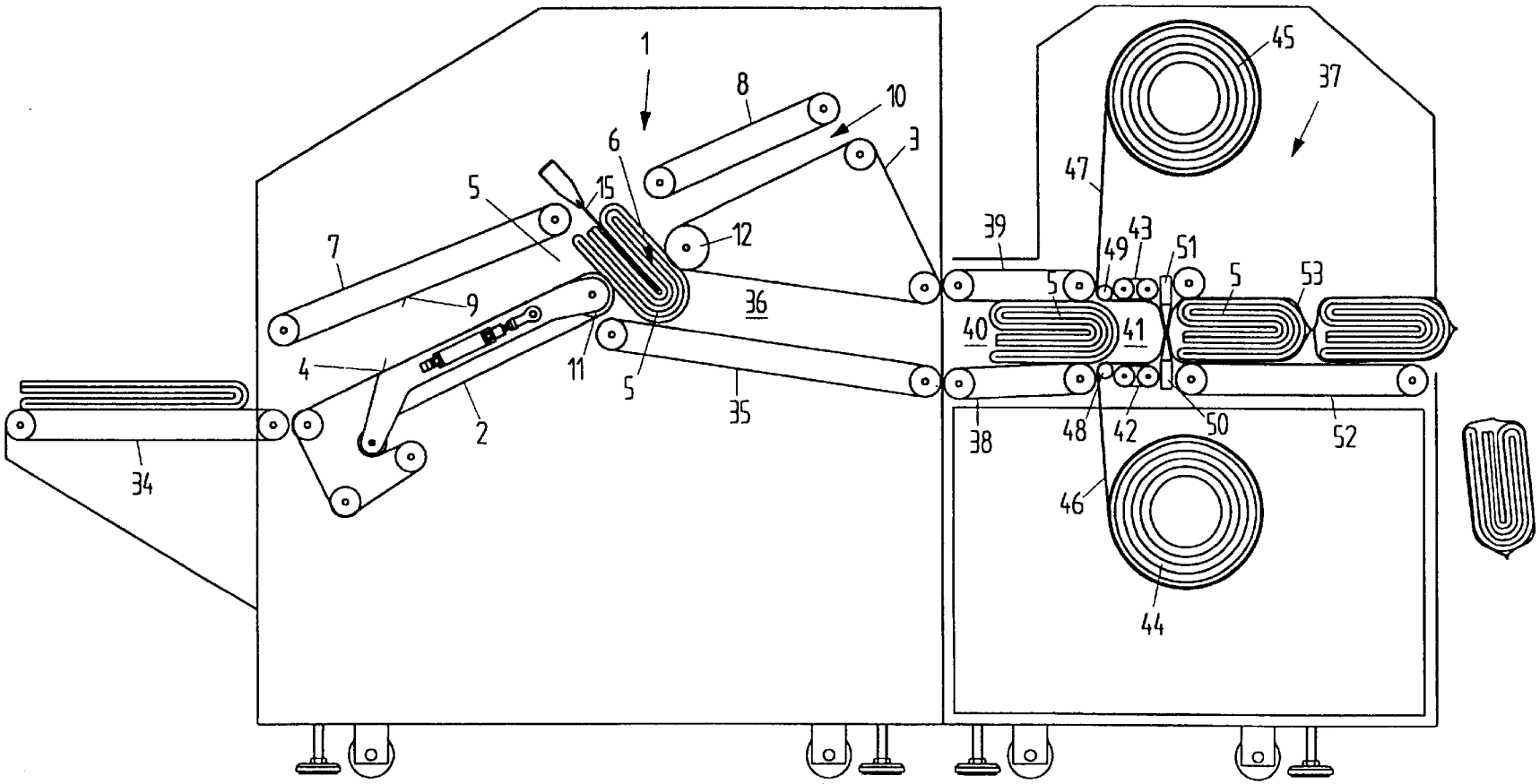
FIG. 3*b* shows a side view corresponding to FIG. 3*a*, with the final folding station in a second state.

The final fold is then performed by widening the gap 6 by slightly drawing back the roller 11 and by moving the folding sword 15 through said gap obliquely downwards and thus pushing the piece of linen 5, with the middle of its lower side facing forwards, into the folding channel 36. The second draw-in belt 3 and the folding belt 35 are moved in such a way that they accompany and support the movement of the piece of linen 5 (FIG. 3*b*). This movement of said belts is maintained until the piece of linen 5 leaves the folding apparatus 1 at the end of the folding channel 36, while the folding sword 15 is withdrawn (FIG. 3*a*).

The piece of linen 5 now enters the transfer channel 40 of the packing apparatus 37, where it is transported onwards by corresponding movement of the first transfer belt 38 and of the second transfer belt 39 and is finally pushed into the packing channel 41 between the webs 46, 47 of packaging material (FIG. 3*b*). Once it has reached the end of the packing channel 41, the contact with the first transfer belt 38 and with the second transfer belt 39 ceases and the piece of linen abuts a weld seam which is made by means of the welding stamps 50, 51 and joins the webs 47, 48. After withdrawal of the welding stamps 50, 51, the packing belts 42, 43 are set in motion so that, with simultaneous withdrawal of packaging material from the storage rollers 44, 45, the piece of linen 5 is transported out of the packaging channel 41 and reaches the delivery belt 52. In this position, the welding stamps 50, 51 are advanced and the webs 47, 48—now behind the piece of linen 5—are welded again (FIG. 3*b*).

The piece of linen 5 has now been brought to a storage position in which it is surrounded by a closed strip 53 of packaging material which consists of two part-strips which are formed from sections of the webs 46, 47 and are connected by two weld seams. The part-strips now exert forces of reaction on the parallel outer surfaces of the piece of linen 5, which forces are directed towards one another and once again prevent opening of the final fold and fix the piece of linen 5 in its final configuration. It is possible to provide further welding stamps, by means of which lateral weld seams joining the part-strips are additionally made, so that said weld seams result in completely closed packaging of the piece of linen. In this case, the webs of packaging material must of course be correspondingly broader than the piece of linen, whereas, in the case described above, they preferably have about the same width but may also be narrower. After further transport on the delivery belt 52, the packed pieces of linen are ejected, whereupon they are separated at the weld seams.

What is decisive for carrying out the process successfully, if it is to be effective on the final folding means according to the first or that according to the second embodiment, is that, after the final folding, pressure is maintained constantly on the parallel outer surfaces of each piece of linen until the latter has been fixed in its final configuration by stacking or packing or in another manner, in a storage position. In the first case, this is effected essentially by the stop surfaces of the receptacle, and in the second case essentially by the transfer belts.

Other embodiments of the invention will be apparent to those skilled in the art from consideration of the specification and practice of the invention disclosed herein. It is intended that the specification and examples be considered as exemplary only. Thus, it should be understood that the invention is not limited to the illustrative examples in this specification. Rather, the invention is intended to cover all modifications and variations that come within the scope of the following claims and their equivalents.

What is claimed is:

1. A process for the sequential automatic final folding and stacking of a series of pieces of linen, comprising:

final folding of the piece of linen into a final configuration having a first outer surface and a second outer surface parallel to said first outer surface and applying forces directed substantially towards the first outer surface and the second outer surface in order to keep the piece of linen in the said final configuration;

transferring each piece of linen to a stack while maintaining the forces acting against the first outer surface and the second outer surface;

fixing each piece of linen on the stack while maintaining it in the final configuration such that the first outer surface and the second outer surface of each piece of linen each rests against a second outer surface or a first outer surface, respectively, of an adjacent piece of linen or against a stop surface;

wherein the stack is bounded at a front end by a first stop surface movable in the direction of the stack, and against which a first outer surface of a first piece of linen is resting;

wherein, during intervals where no piece of linen is transferred to the stack, the stack is bounded at a back end opposite said front end by a second stop surface at an active position from which it is removable and against which second stop surface a second outer surface of an outermost piece of linen is resting; and wherein, when a piece of linen is transferred to the stack, the piece of linen is placed behind the second stop surface, the second stop surface is removed from an active position, the piece of linen is, by a push surface reciprocatable in the direction of the stack, pushed onto the stack at a back end of the same, the second stop surface is moved back to its active position, the push surface is drawn back behind the second stop surface such that the second outer surface of the said piece of linen, which is now an outermost piece of linen, rests against the second stop surface.

2. A process for the sequential automatic final folding and stacking of a series of pieces of linen, comprising:

final folding of each piece of linen into a final configuration having a first outer surface and a second outer surface parallel to said first outer surface by applying substantially perpendicular forces against the first outer surface and the second outer surface of the piece of linen while the first and second outer surfaces are contiguous and coplanar;

transferring each piece of linen to a stack while maintaining the forces applied against the first outer surface and the second outer surface in order to keep each piece of linen in the final folding configuration, the stack being, at a front end, bounded by a first stop surface movable along a direction parallel to a longitudinal direction of the stack, while a first outer surface of a first piece of linen rests upon the first stop surface, and by carrying out the following steps:

placing a piece of linen at a first position behind a second stop surface bounding the stack at a back end opposite said front end, while a second outer surface of an outermost piece of linen rests against the second stop surface;

moving the second stop surface away from the first position and toward a second position;

pushing the piece of linen, by a push surface reciprocatable in a direction of the stack, onto the stack at the back end of the stack;

moving the second stop surface back to the first position; and drawing the push surface back behind the second stop surface such that the second outer surface of the piece of linen, which is now the outermost piece of linen, rests against the second stop surface.

* * * * *